United States Patent [19]

Green et al.

[11] Patent Number: 4,660,737

[45] Date of Patent: Apr. 28, 1987

[54] CARTON AND POUCH SYSTEM

[75] Inventors: Timothy Green, East Windsor; Harry Kaufman, Princeton; Charles Jalovec, Manalapan, all of N.J.

[73] Assignee: General Foods Corporation, White Plains, N.Y.

[21] Appl. No.: 847,359

[22] Filed: Apr. 2, 1986

[51] Int. Cl.[4] ..... B65D 9/04

[52] U.S. Cl. ..... 220/410; 220/403; 222/105

[58] Field of Search ..... 220/410, 402, 403; 222/105, 106, 107, 185

[56] References Cited

U.S. PATENT DOCUMENTS

| | | | |
|---|---|---|---|
| 2,954,901 | 10/1960 | Winstead | 220/410 X |
| 3,078,026 | 2/1963 | Meinecke et al. | 220/410 X |
| 3,169,690 | 2/1965 | Scholle | 220/403 |
| 3,172,570 | 3/1965 | Lipschutz | 222/105 |
| 3,178,064 | 4/1965 | Layne | 222/105 |
| 3,233,817 | 2/1966 | Casady | 220/403 |
| 3,453,033 | 7/1969 | Goss | 220/403 X |
| 3,539,360 | 11/1970 | Wood | 220/403 X |
| 4,560,090 | 12/1985 | Okushita | 222/105 X |

*Primary Examiner*—Steven M. Pollard

*Attorney, Agent, or Firm*—Barbara Toop D'Avanzo; Thomas R. Savoie; Daniel J. Donovan

[57] ABSTRACT

A packaging container for the dispensing of a liquid product, more specifically, a carton and pouch system comprising a flexible pouch inserted in a closely form-fitting relationship with an outer relatively rigid carton. A means of access to the liquid in the pouch is provided by a combination of a plurality of intersecting slits superimposed over a through aperature.

5 Claims, 5 Drawing Figures

FIG.1
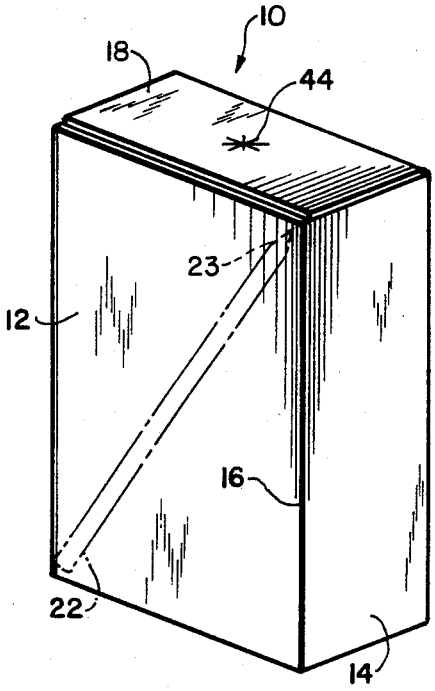
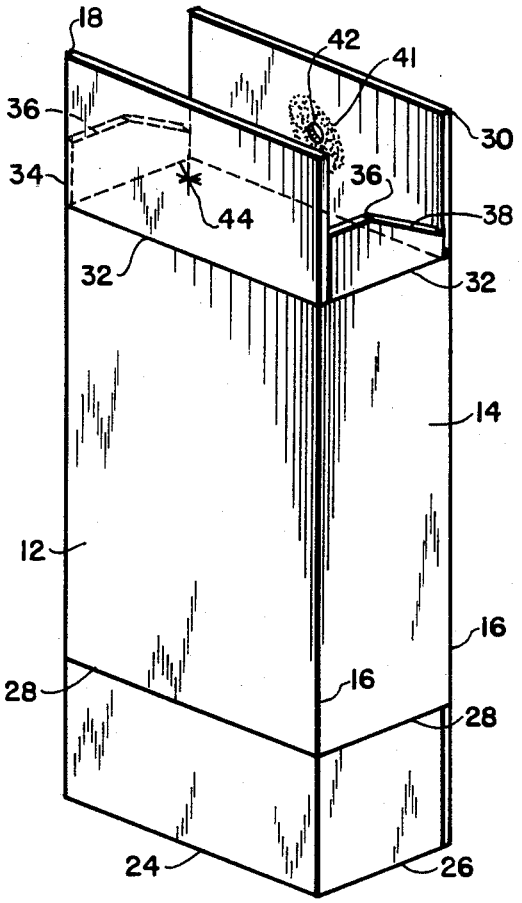
FIG.2
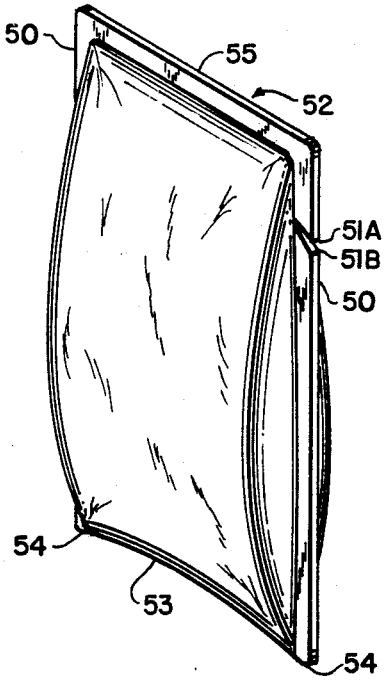
FIG.3

FIG.4
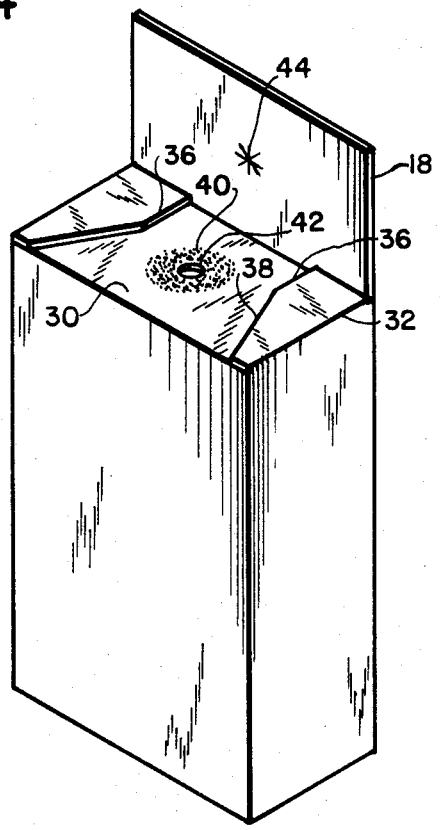
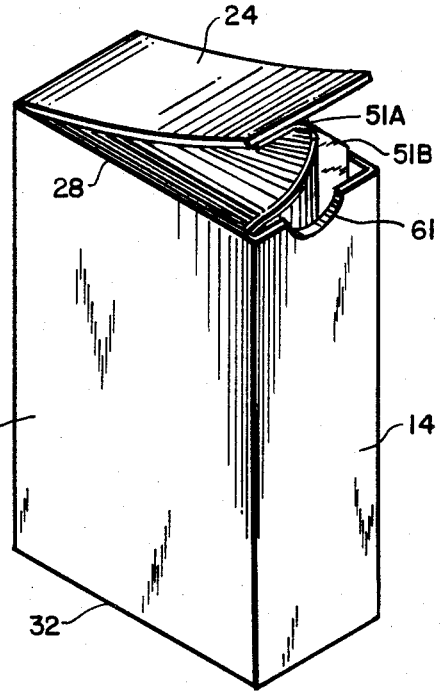
FIG.5

CARTON AND POUCH SYSTEM

BACKGROUND OF THE INVENTION

1. Technical Background

The present invention relates to a packaging container for the dispensing of a liquid product, and more specifically, it relates to a carton and pouch system, preferably of the single serving type. The system is comprised of a sealed flexible pouch within which there is contained a liquid. The pouch is inserted in or encased within an outer relatively rigid casing or carton. The casing or carton is sealed so as to completely encompass the liquid containing sealed pouch. There is also provided a means to access the liquid within the pouch, by inserting a rigid implement, such as a drinking straw, through the carton and into the sealed pouch.

2. Background Art

Individual serving beverage containers have been developed whereby the containers are essentially comprised of a lamination of an external, substantially stiff outer wall construction, and one or more inner layers, so as to provide a liquid impervious, high gas barrier construction. Many of these containers are rendered aseptic by rinsing through a sterilizing agent, such as hydrogen peroxide. The result of this is to produce a product which is shelf-stable for a substantial period of time.

The outer layer of the wall of the container is many times constructed from stiff paper such as cardboard. The inner layers can consist of foil, or thermoplastics.

Patents which disclose packages as described above are U.S. Pat. Nos. 4,424,260; 4,113,103; 3,795,359; and 3,650,458. All of these patents are commonly assigned to Tetra Pak International, AB, Sweeden.

The containers disclosed in the above-cited U.S. patents, feature an aperature in the form of a small circular opening provided through the exterior layer of the container to facilitate the piercing of the inner layer or layers by a rigid drinking element, such as a straw.

Another type of opening is disclosed in U.S. Pat. No. 3,792,798 which depicts a combination liquid container and straw. A variety of shaped openings are shown, which allow for, at least, a partial deformation, and clamping of the straw.

SUMMARY OF THE INVENTION

The present invention relates to a packaging container for the dispensing of liquids. It provides for a novel and unique pouch and carton system, including a means of accessing the liquid contained within the pouch. Due to the nature of the present invention, a pouch within a carton, the air space between the carton and the pouch acts as an insulator. Therefore, liquid within the carton will retain its temperature over a longer period of time then in the other beverage containers presently on the market, and described above. The packaging container is essentially constituted of the combination of two components, namely, an outer cardboard casing which is relatively rigid and which is produced by commonly employed and well known carton manufacturing apparatus and methods. Within this carton is arranged a flexible, sealed pouch of a thin-walled material containing a liquid product, the filled flexible pouch being in substantial conformance with and filling out the interior dimensions or volume of the outer cardboard casing. The carton consists of upper and lower closure ends, each of which is comprised of a plurality of end flaps. The upper closure end comprises a minimum of two overlapping end flaps, the inner of which is in contact with the pouch, and the outer of which forms the outer surface of the carton on that end. The inner flap is provided with a through aperture, the outer flap is provided with a plurality of intersecting slits, together forming the means for accessing the liquid within the pouch. A piercing instrument is provided in order to pass through the intersecting slits and the through aperture and puncture the flexible pouch.

On the interior side of the inner flap, there is provided an adhesive which encompasses the through aperture and effectively provides a liquid-tight seal between the casing and the flexible pouch. Upon puncturing of the pouch by the rigid instrument, the liquid will be inhibited from leaking into the space between the pouch and the casing.

DESCRIPTION OF THE DRAWINGS

Referring to the drawings:

FIG. 1 illustrates a perspective view of the carton and pouch system, in its filled and sealed condition;

FIG. 2 illustrates the outer casing or carton portion of the system in a perspective view;

FIG. 3 illustrates a perspective view of the pouch portion of the system;

FIG. 4 illustrates a perspective view of the carton and pouch system in a semi-sealed position, and in particular illustrates the sealing order of the end flaps of the carton; and FIG. 5 illustrates an alternate embodiment, in particular, an alternate means of accessing the liquid in the carton and pouch system.

DETAILED DESCRIPTION

Referring now in detail to the drawings, and particularly FIG. 1, there is illustrated a perspective view of a beverage packaging container 10 of the individual serving type constructed pursuant to the invention. As illustrated, the packaging container 10 is of a box-like or parallelipiped external configuration, having a front panel 12 and a similar rear panel (not shown) interconnected by means of end panels 14 (only one being shown) along suitable fold lines 16 in conformance with carbon constructions as currently employed in the art.

The outer casing of the beverage container 10, as illustrated in FIG. 2 of the drawings, may be constructed of suitable cardboard, paper or paperboard of a relatively rigid but somewhat flexible consistency so as to provide protection against crushing of the package by an externally applied force.

The lower or bottom end portion of the container casing may be provided with flaps 24 extending from each of the side wall panels 12 and flaps 26 extending from each of the end wall panels 14, with the flaps 24, 26 being foldable inwardly along hinge or fold lines 28 so as to, when provided with suitable adhesives, form a sealed carton end closure. In FIG. 2, the carbon has been rotated 180° from its position in FIG. 1, so that the rear panel 12 is showing, and front panel 12 is not shown.

The top or upper end portion of the container casing has a front panel 12 provided with a first flap member 30 having a surface area substantially conforming with the opening dimensions of the casing defined by panels 12 and 14, and is foldable inwardly about a hinge or fold line 32 at the end of the front wall panel 12, whereas the opposite side wall panel, the rear panel 12 is provided with a similarly dimensioned end closure flap 18 also foldable inwardly about a hinge line 32, while the end wall panels 14 are provided with end closure flaps 35 which Are also foldable inwardly along hinge line 32, with one edge 38 of each flap 36 being tapered downwardly.

The end closure flap 30 is also provided with a through aperture 42, preferably in the shape of a circular bore hole, arranged within the area defined by the adhesive material 41.

The surface of the flap 30 facing towards the interior of the beverage container includes an area 41 which is covered with an adhesive material, such as a pressure-sensitive adhesive, an adhesive transfer tape, a liquid adhesive, a hot-melt adhesive or any other suitable rapidly adhering material which is capable of forming a liquid-tight seal. There is also provided, on the outward facing surface of flap 30, an area of adhesive material 40 which forms a seal between flaps 30 and 34 (shown in FIG. 4). In this embodiment, the adhesive is shown as being of a spherical shape, as is necessary in order to form the liquid tight seal between the pouch and carton, around the through aperture 42. However, if a liquid tight seal is not required, the adhesive material could be applied in other manners.

The flap 18 is provided with a plurality of intersecting slits 44, all intersecting at their midpoints, which give the appearance of a star. The slits from tongues, which bend downward upon application thereto of one end of a stiff implement, such as a drinking straw, for insertion into the carton. The resilience of the tongues will cause them to hold the straw functionally in position. Two or more intersecting slits may be used, depending upon various factors, such as the type of carton material. In addition, the tongues of the slits, when forced downward, protrude through the through aperture and thus, in combination will the two adhesive areas 40, 41, prevent seepage of the liquid between the flaps, and/or through the starhole itself.

When the flaps 30, 18 are folded inwardly, the plurality of slits 44, will be superimposed over the through aperture 42, so as to provide a means for accessing the liquid, as by a drinking straw. It is an advantage of this invention that due to the nature of the slits 44 in the flap 18, they do not have to be perfectly sumperimposed over the through aperture 42. When an implement, such as a drinking staw, is pushed through the slits, it will find the aperture and center itself therein. The slits 44, therefore, provide a more flexible means of access to the beverage, which compensate for the lack of precise assembly or manufacture of the carton. The placement of the slits and aperture combination in the center of the carton, provides the added feature of preventing the loss of the entire straw inside the carton.

The outer surface of the packaging container 10 may be provided, if desired, with a glossy or decorative multi-color finish coating or layer, and may have suitable indicia such as advertising legends, imprinted or embossed thereon.

Referring now to FIG. 3 of the drawings, there is illustrated a sealed pouch 52 of a thin-walled, flexible, puncture resistant material, such as polyester, linear low-density polyethylene, or nylon. The material is required to be of a liquid-impervious consistency. If desired, the interior of the flexible pouch 52 may be imparted with an aseptic environment by sterilizing with a suitable agent such as, for instance, hydrogen peroxide, so as to impart a long shelf-life to the enclosed liquid produce without the necessity for the refrigeration thereof.

The pouch may be formed from a single heat-sealed sheet of material or a sheet which has a heat sealable layer or coating. The material is folded in half along the fold line 53, and sealed along one side seam 50 and the bottom seam 55. The final seal 50 is not completed until after the pouch has been filled with the liquid. Of course, this sequence may vary, depending upon the equipment used. One seal 50 is provided with a slit, the sides of the slit shown as 51A and 51B. It is needed when the beverage is being accessed by alternate means, as described more fully below.

The formation and construction of the finished and sealed beverage packaging container 10 is essentially as follows:

The outer casing of the beverage packaging container 10, is formed, as shown in FIG. 2 of the drawings, from a suitable precut paperboard blank, with the front and rear wall panels 12, and side panels 14 being interconnected along one end by means of a suitable side closure flap (not shown) forming an extension of one of the wall panels and being adhesively joined to an adjoining wall panel surface. Thereafter, the flap 30 is folded inwardly about fold line 32, the end flaps 36 are folded inwardly into surface contact with the outwardly facing surface of the flap 30, with the tapered edge 38 of each of the flaps 36 ensuring that the aperture of 42 will not be covered by the flaps 36. This unconventional folding sequence is used so as to insure the best possible contact between the pouch and the carton at the area surrounding the through aperture. FIG. 4 illustrates somewhat how the carton pouch system would look at this stage in the forming process. In the actual process, the bottom flaps are not sealed until after the pouch is placed within the carton. The flap 18 is then folded downwardly into superposition on the flaps 36 and flaps 30, so that the plurality of slits 44 are aligned with the aperture 42 in the flap 30. As previously started, it is not necessary that there be precise superposition or alignment, since the nature of the slits 44 compensates for some variation.

The end closure of the container 10 represented by the flaps 30, 36 and 18 is sealed by providing a suitable adhesive within an area 40 to either the inner surface of the flap 18 and/or the outer surfaces of the flaps 30 and/or 36. In FIG. 4, the embodiment is shown wherein the adhesive 40, applied on flap 30, surrounds the through aperture 42. However, the preferred embodiment comprises two lines of adhesive, one on either side of the through aperture 42, running perpendicular to the end flaps 36. Placement of the adhesive in this manner provides less likelihood that any adhesive would come in contact with the through aperture, and subsequently with the liquid. In addition, it would provide an excellent seal, as the thickness of the adhesive would help to compensate for the space between the two flaps 30 and 18, corresponding to the thickness of the end flaps 36.

After the top end of the carton has been folded and sealed, the next stop is to introduce adhesive onto the interior of flap 30 in the area designated 41. This adhesive will form the liquid-tight seal between the pouch and the carton. It will also hold the pouch taut, so as to provide a surface which will not move, but which will puncture when contacted by the appropriate instrument. A suitable adhesive, which would be known to those skilled in the art, is positioned on the interior side of the inner flap 30 as illustrated in FIG. 2. The preferred embodiment is shown, where the adhesive covers a spherical area surrounding the through aperture 42.

The flexible pouch 52 containing the liquid product is placed within the carton, being of a size and fill volume which will substantially completely fill the interior of the outer casing of the container 10. The pouch is placed in upside down so that the bottom fold 53 of the pouch will be substantially flat and coplanar with the fold line 32 of the container end closure flaps, and with the corners 54 of the pouch 52 being folded so that they are parallel to the sidess of the pouch. A head space may be provided for any gases within the flexible pouch. If a head space is provided, it should ensure that the upper or folded surface of the pouch 50 is relatively flush with the upper end of the container 10 along the plane represented by the fold or hinge lines 32. If different machinery were involved, it would be possible to follow a different sequence of placing the pouch inside the carton. Most importantly, it must be remembered to place the pouch within the carton with the seamless side of the pouch 53 in contact with the interior flap 30.

Thereafter, the container bottom closure flaps 26, 24 are folded inwardly along the fold or hinge lines 28, and fastened to each other by means of a suitable adhesive (not shown).

When it is desired to dispense the liquid contents of the flexible pouch 52, a suitable piercing implement, such as the drinking straw 22, may be readily detached from the container 10, one end thereof having a sharp point or edge 23 which is pushed through the slits 44 and aperture 42 to access the liquid.

As stated previously, the pouch is made from puncture resistant material which, in combination with the straw, provides a safety feature. The only end of the straw able to puncture the pouch is the sharpened end. Therefore, one cannot accidently put the dull end through the bag, and the pointed end in the mouth. The system will only work if the pointed end is pushed through the slits, and into the pouch.

At this point, the liquid product may be consumed through the drinking straw 22 directly from the interior of the pouch 52. The presence of the liquid-tight seal between the flexible pouch 52 and the inner wall surface of the closure flap 30, as a result of the adhesive material designated at 40 about the through aperture 42 will prevent any leakage or spillage of the liquid contents into the interspace between the outer casing and the flexible pouch and ensure that the entire product will be properly dispensed notwithstanding the collapsing of the pouch during emptying thereof.

An alternate means of accessing the liquid with the pouch is illustrated in FIG. 5. The carton may be provided with an alternate means of entry, either alone or in addition to the slits and through aperture provision. FIG. 5 shows the carton on its opposite end, so that one of the end flaps 24 is on top. In this embodiment, fold line 28 is a perforated line along the two side panels 12 and the end panel 14 in which the thumbhole perforation 61 is placed. The remaining fold line 28 is the same as previously shown. The thumbhole perforation 61 is shown here in the opened position. The thumbnotch would, after opening the carton, be annexed to end flap 24, and would be pushed to its underside, but is not shown herein. There is a pre-cut slit in the side seam 50 of the pouch 52, the two sides of the slit being illustrated as 51A and 51B in this figure. This means of accessing the liquid requires processing down on the thumbhole perforation and pulling the end flaps 24 back along perforated line 28. The corner of the seam 55 of the pouch 52 located near the thumbhole perforation is adhesively attached to the inside of the end flaps 24 or 26 (not shown). As the flap is pulled back, the glued portion of the pouch will be pulled away with the flap 24, along slit 51, and the pouch will be opened so as to enable one to pour the liquid into another container if it is so desired.

Although the inventive beverage packaging container 10 has been described and illustrated hedrein as being represented by a parallelipiped package construction, preferably a box-like, rectangular individual serving beverage container having a usual single serving capacity of 250 milliliters (8.4 fluid ounces) in which the dimensions of the outer casing would be about $4\frac{1}{4}\times1\frac{5}{8}\times2\frac{5}{8}$ inches, it will be readily apparent to one skilled in the art that other suitable container sizes and shapes may be readily constructed in dependence upon a different product fill capacities as desired for a particular product.

Furthermore, although the packaging container 10 is illustrated herein as having a box-like or parallelipiped configuration, it may also be readily apparent to one skilled in the art that the container can be readily of a cylindrical, pyramidal, frustoconical or other suitable type of geometric shape as may be desired by the particular manufacturer and consumer demands.

While there has been shown and described what is considered to be preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention therein disclosed as hereinafter claimed.

I claim:

1. A packaging container for the dispensing of a liquid product, comprising:

(a) an outer, relatively rigid casing of carton material including encompassing side wall structure, and top and bottom closure flaps extending from the opposite ends of said wall structure, said closure flaps being inwardly foldable to form end closures and providing a sealed casing structure;

(b) a through aperture formed in the inner folding flap of one set of end closures, and a plurality of intersecting slits on the outer flap of the same set of end closures, the slits being generally superimposed on the aperture, and adhesive means on the interior surface of the inner folding flap of the end closure, encompassing said aperture;

(c) a flexible, liquid impervious, thin-walled sealed pouch containing a liquid product, being arranged within said casing, said pouch being dimensioned to have a full volume substantially conforming with the interior volume of said casing, said pouch being adhesively fastened to the inner surface of said casing end provided with the through aperture, said pouch in contact with said adhesive means so as to form a liquid-tight seal about said aperture, between the casing and the pouch, whereby puncturing of the pouch at the location of said aperture facilitates dispensing of liquid from said pouch through said aperture, while concurrently preventing leakage of liquid into the space between said casing and said pouch formed during the emptying of said pouch.

2. A packaging container as set forth in claim 1 wherein the pouch is comprised of a puncture resistant material.

3. A packaging contaner as set forth in claim 1 wherein the plurality of slits consists of three (3) slits, all intersecting at their midpoints, forming a star configuration.

4. A packaging container as set forth in claim 1 which further comprises piercing means, insertable through the plurality of slits and the through aperture, one end of said means shaped into a point.

5. A packaging container as set forth in claim 1 which further comprises an alternate means of entry into the pouch, thereby the pouch is pre-slit along a seam and said seam is adhered to the inside flap of said outer container, so as to facilitate the ripping of said pouch along the slit when the container flap is ripped back along the provided perforations.

* * * * *